US012710223B1

(12) United States Patent
Grant

(10) Patent No.: US 12,710,223 B1
(45) Date of Patent: Aug. 18, 2026

(54) REFRIGERATOR WITH SEQUENTIAL INTERIOR LIGHTING

(71) Applicant: Midea Group Co., Ltd., Foshan (CN)

(72) Inventor: Michael Grant, Taylorsville, KY (US)

(73) Assignee: MIDEA GROUP CO., LTD., Beijiao (CN)

( * ) Notice: Subject to any disclaimer, the term of this patent is extended or adjusted under 35 U.S.C. 154(b) by 0 days.

(21) Appl. No.: 19/053,673

(22) Filed: Feb. 14, 2025

(51) Int. Cl.
*F25D 27/00* (2006.01)

(52) U.S. Cl.
CPC ..... *F25D 27/005* (2013.01); *F25D 2700/02* (2013.01)

(58) Field of Classification Search
None
See application file for complete search history.

(56) References Cited

U.S. PATENT DOCUMENTS

| | | | | |
|---|---|---|---|---|
| 8,393,746 | B2 | 3/2013 | Lee | |
| 2012/0235568 | A1* | 9/2012 | Prodin | B60Q 3/80 315/77 |
| 2014/0268646 | A1* | 9/2014 | Kendall | F24C 7/082 362/92 |
| 2015/0035432 | A1* | 2/2015 | Kendall | F25D 27/005 315/76 |
| 2016/0192459 | A1 | 6/2016 | Siminovitch | |
| 2016/0374175 | A1 | 12/2016 | Koo | |
| 2018/0031310 | A1* | 2/2018 | Kendall | F25D 27/00 |
| 2018/0217724 | A1* | 8/2018 | Shoji | G06F 3/04817 |
| 2022/0412645 | A1* | 12/2022 | Bihr | F25D 29/005 |
| 2023/0015832 | A1* | 1/2023 | Song | F25D 27/00 |
| 2024/0081596 | A1* | 3/2024 | Chung | A47L 7/0009 |
| 2024/0377121 | A1* | 11/2024 | Hong | F25D 29/00 |

FOREIGN PATENT DOCUMENTS

| | | | |
|---|---|---|---|
| CN | 102213535 | A | 10/2011 |
| CN | 203011069 | U | 6/2013 |
| CN | 204180342 | U | 2/2015 |
| CN | 114646184 | A | 6/2022 |
| CN | 117168051 | A | 12/2023 |
| CN | 117663652 | A | 3/2024 |
| EP | 3086067 | A1 | 10/2016 |
| EP | 4375600 | A1 | 5/2024 |

OTHER PUBLICATIONS

Kitchenaid, 29.4 Cu. Ft. 48" Built-In Side-by-Side Refrigerator with Ice and Water Dispenser, 9 pages, Retrieved from: https://www.kitchenaid.com/major-appliances/refrigeration/refrigerators/side-by-side-refrigerators/p.29.4-cu.-ft.-48-built-in-side-by-side-refrigerator-with-ice-and-water-dispenser.kbsd708mps.html, 2024.

* cited by examiner

*Primary Examiner* — Christopher E Dunay
(74) *Attorney, Agent, or Firm* — Gray Ice Higdon

(57) ABSTRACT

A refrigerator includes sequential interior lighting to dynamically vary the light level in a compartment of the refrigerator. At least one light of a plurality of lights in the compartment may be activated after activation of at least one other light of the plurality of lights upon opening of a door such that the brightness level in the compartment progressively increases after opening of the door, thereby enabling a user's eyes to better acclimate to the compartment illumination.

20 Claims, 5 Drawing Sheets

REFRIGERATOR WITH SEQUENTIAL INTERIOR LIGHTING

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Various refrigerator designs have been used, including, for example, top mount refrigerators, which include a freezer compartment near the top of the refrigerator, either accessible via a separate external door from the external door for the fresh food compartment, or accessible via an internal door within the fresh food compartment; side-by-side refrigerators, which orient the freezer and fresh food compartments next to one another and extending generally along most of the height of the refrigerator; and bottom mount refrigerators, which orient the freezer compartment below the fresh food compartment and including sliding and/or hinged doors to provide access to the freezer and fresh food compartments. In addition, some refrigerators may only include a single fresh food compartment or freezer compartment, with the latter also generally referred to as a freezer.

Irrespective of the refrigerator design employed, many refrigerator designs also include an interior lighting system to illuminate the interior of a compartment when a door to the compartment has been opened and thereby assist a user with locating items in the compartment. Conventional lighting systems, however, generally illuminate the compartment by activating all lights concurrently with opening of the door and at a single brightness level, and regardless of the amount of light in the ambient environment surrounding the refrigerator. As such, the same brightness level is used regardless of whether the refrigerator is in a bright kitchen during the day or it is late at night and the lights in the kitchen are off. Particularly when in a dark kitchen, the brightness level may initially be too bright for a user and require some period of time to allow the user's eyes to acclimate before the user can locate a desired item in the compartment. Doing so is both uncomfortable to the user, as well as energy inefficient, as the amount of time the lights are activated, as well as the amount of time the door remains open and allows warm ambient air into the compartment, generally increases.

Therefore, a continuing need exists for an improved manner of illuminating a compartment of a refrigerator that provides a more pleasing user experience.

SUMMARY

The herein-described implementations address these and other problems associated with the art by utilizing sequential interior lighting in a refrigerator to dynamically vary the light level in a compartment of the refrigerator. At least one light of a plurality of lights in the compartment may be activated after activation of at least one other light of the plurality of lights upon opening of a door such that the brightness level in the compartment progressively increases after opening of the door, thereby enabling a user's eyes to better acclimate to the compartment illumination.

Therefore, consistent with one aspect of the invention, a refrigerator may include a cabinet including a food storage compartment defined therein, a door coupled to the cabinet to provide external access to the food storage compartment, the door movable between closed and open positions, a plurality of lights disposed within the food storage compartment, and a controller coupled to the plurality of lights, the controller configured to detect opening of the door, and the controller further configured to, in response to detecting opening of the door, illuminate the food storage compartment by sequentially activating first and second lights of the plurality of lights such that the first light is activated prior to activation of the second light.

In some implementations, the controller is further configured to illuminate the food storage compartment by sequentially activating a third light of the plurality of lights such that the third light is activated after activation of each of the first and second lights. Also, in some implementations, the controller is configured to sequentially activate the first and second lights of the plurality of lights by activating the first light, waiting a predetermined duration after activating the first light, and activating the second light after waiting the predetermined duration.

Further, in some implementations, the plurality of lights includes a one-dimensional array of three or more lights, and the controller is configured to illuminate the food storage compartment by sequentially activating the three or more lights along a length of the one-dimensional array. In some implementations, the one-dimensional array is linear. In addition, in some implementations, at least a portion of the one-dimensional array is curved. In some implementations, at least a portion of the one-dimensional array is arranged in a generally back to front direction within the food storage compartment, and the controller is configured to illuminate the food storage compartment by sequentially activating the at least a portion of the one-dimensional array in a generally back to front or front to back direction to generate a back to front or front to back animation. In addition, in some implementations, the plurality of lights includes a first subset of lights extending generally from a midline of the food storage compartment to and along a first side wall of the food storage compartment and a second subset of lights extending generally from the midline to and along a second side wall of the food storage compartment, and the controller is configured to illuminate the food storage compartment by sequentially activating lights from each of the first and second subset of lights starting proximate the midline to generate a wraparound animation.

Moreover, in some implementations, the first light is among a first subset of the plurality of lights and the second light is among a second subset of the plurality of lights, each of the first and second subsets of the plurality of lights includes more than one light, and the controller is configured to concurrently activate the first subset of lights when activating the first light and concurrently activate the second subset of lights when activating the second light. In some implementations, the plurality of lights further includes a third subset including more than one light, and the controller is configured to concurrently activate the first third subset of lights sequentially after activating the second subset of lights.

Some implementations may also include a door position sensor, and the controller is configured to detect opening of the door using the door position sensor. Moreover, in some implementations, the door position sensor is configured to detect a plurality of open positions of the door having different rotational differences from the closed position, and the controller is configured to illuminate the food storage compartment by increasing a number of activated lights of the plurality of lights as a current position of the door moves away from the closed position.

In some implementations, at least one of the plurality of lights has a variable intensity, and the controller is further configured to vary the intensity of the at least one of the plurality of lights when illuminating the food storage compartment. Some implementations may also include an ambient light sensor, and the controller is configured to sequentially activate first and second lights of the plurality of lights further based on an ambient light level sensed by the ambient light sensor. In addition, in some implementations, the controller is configured to sequentially activate the first and second lights in response to the ambient light level meeting a low light criterion, and to activate the first and second lights concurrently in response to the ambient light level not meeting the low light criterion.

In some implementations, at least a subset of the plurality of lights is disposed on a rear wall, a side wall, a top wall or a bottom wall of the food storage compartment. Moreover, in some implementations, at least a subset of the plurality of lights is disposed on a component disposed in the food storage compartment, and the component is a shelf, a drawer, a filter, or a control panel. Also, in some implementations, at least a subset of the plurality of lights is disposed on an interior surface of the door.

Some implementations may also include a drawer disposed in the food storage compartment, with at least a subset of the plurality of lights positioned to illuminate an interior of the drawer, and the controller is further configured to detect opening of the drawer, and in response to detecting opening of the drawer, illuminate the interior of the drawer using the subset of the plurality of lights.

Consistent with another aspect of the invention, a method of illuminating a refrigerator of a type including a cabinet having a food storage compartment defined therein and a door coupled to the cabinet to provide external access to the food storage compartment and movable between closed and open positions may include, with a controller of the refrigerator, detecting opening of the door, and in response to detecting opening of the door, illuminating the food storage compartment by sequentially activating first and second lights of a plurality of lights disposed in the food storage compartment such that the first light is activated prior to activation of the second light.

Other implementations may include a method of operating any of the aforementioned refrigerators.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example implementations of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
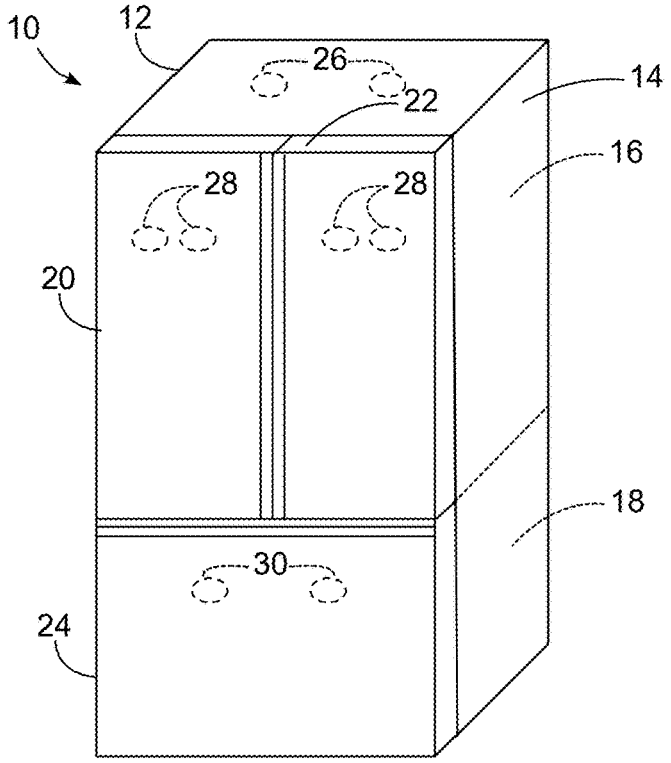
FIG. 1 is a perspective view of a refrigerator consistent with some implementations.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet 12 including a main case 14 housing one or more food storage compartments (e.g., a fresh food compartment 16 and a freezer compartment 18), as well as one or more fresh food compartment doors 20, 22 and one or more freezer compartment doors 24 disposed adjacent respective openings of food storage compartments 16, 18 and configured to insulate the respective food storage compartments 16, 18 from an exterior environment when the doors are closed.

Fresh food compartment 16 is generally maintained at a temperature above freezing for storing fresh food such as produce, drinks, eggs, condiments, lunchmeat, cheese, etc. Various shelves, drawers, and/or sub-compartments may be provided within fresh food compartment 16 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 18 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, and includes a pair of side-by-side fresh food compartment doors 20, 22 that are hinged along the left and right sides of the refrigerator to provide a wide opening for accessing the fresh food compartment, as well as a single sliding freezer compartment door 24 that is similar to a drawer and that pulls out to provide access to items in the freezer compartment. It will be appreciated, however, that other door designs may be used in other implementations, including various combinations and numbers of hinged and/or sliding doors for each of the fresh food and freezer compartments. Moreover, while refrigerator 10 is a bottom mount refrigerator with freezer compartment 18 disposed below fresh food compartment 16, the invention is not so limited, and as such, the principles and techniques may be used in connection with other types of refrigerators in other implementations.

Figure 3:
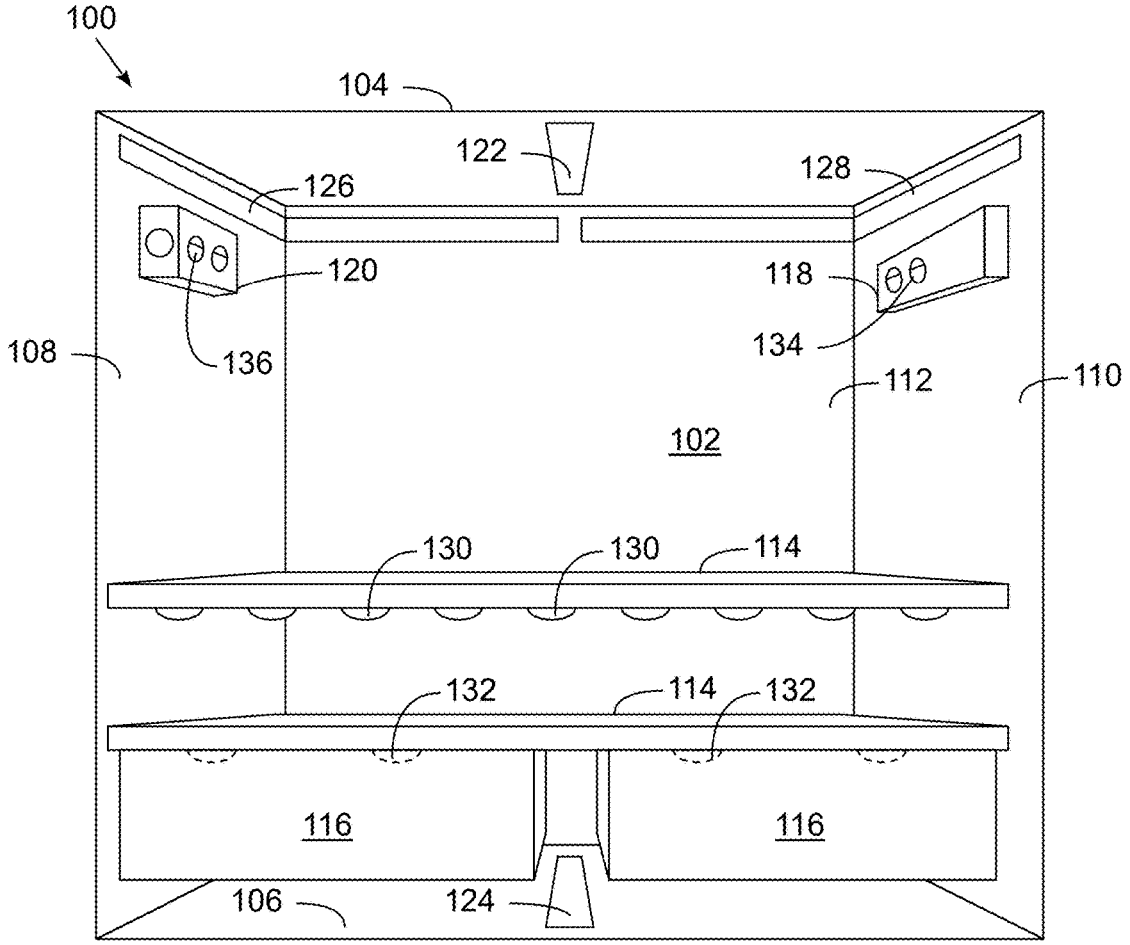
FIG. 3 is a front elevational view of an example fresh food compartment capable of being used in the refrigerator of FIGS. 1-2.

Refrigerator 10 also includes one or more interior lights 26, 28, 30 configured to illuminate the interior of a compartment 16, 18 when a door 20, 22, 24 has been opened to provide external access to the compartment 16, 18. As will be discussed in greater detail below, and as illustrated in FIG. 1, interior lights 26 may be disposed on the walls of a compartment (e.g., as illustrated by interior lights 26 for fresh food compartment 16 and interior lights 30 for freezer compartment 18), an interior surface of a door (e.g., as illustrated by interior lights 28 on interior surfaces of doors 20, 22, and/or other structures within a compartment (as illustrated in FIG. 3, below).

Figure 2:
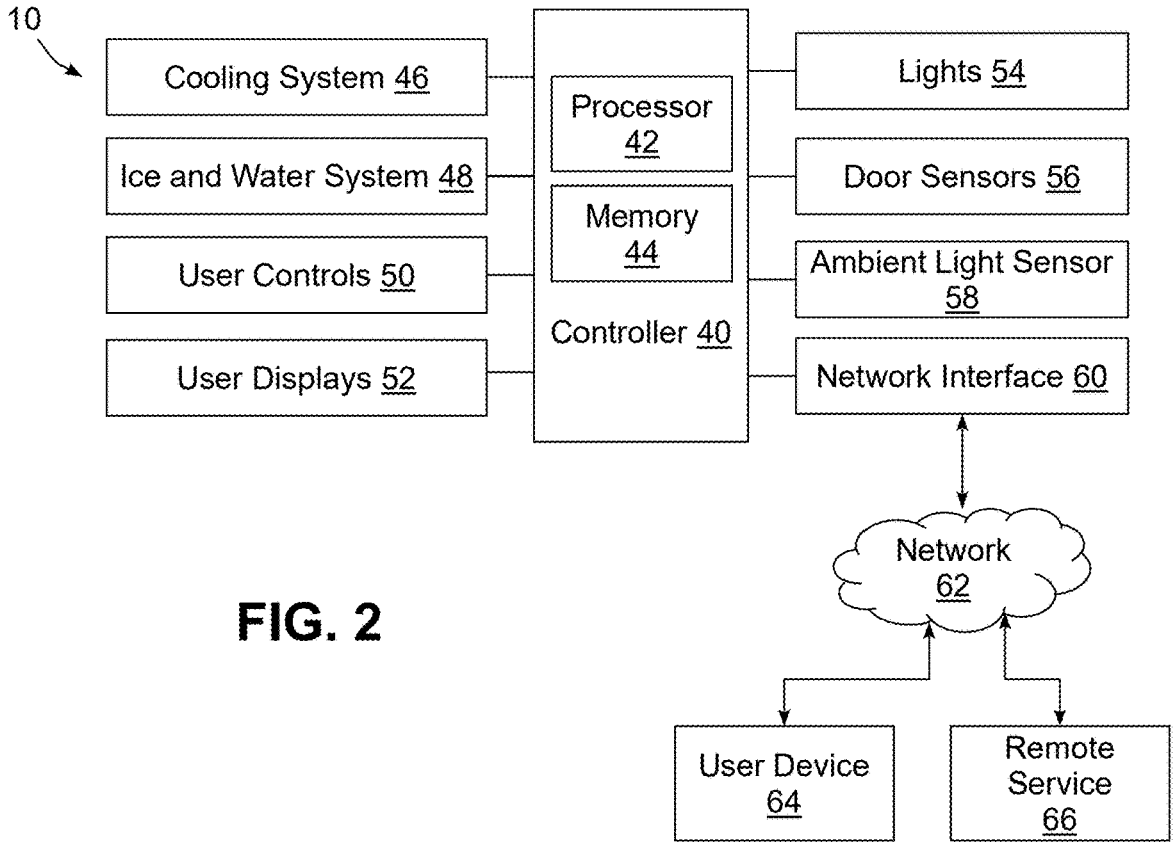
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example implementation of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40. Controller 40 may also be distributed among multiple controller circuits within refrigerator 12 in some implementations, so the invention should not be considered to be limited to a controller implemented as a single central controller circuit as is illustrated in FIG. 2.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc., as well as one or more variable controls as discussed in greater detail below), and one or more user displays 52 (including various indicators, graphical displays, textual displays, speakers, etc.), as well as various additional components suitable for use in a refrigerator, e.g., interior and/or exterior lighting 54, among others. At least a portion of user controls 50 and user displays 52 may be implemented in an interior control panel disposed within a compartment or an exterior control panel, e.g., disposed on one of doors 20, 22 in some implementations.

Controller 40 may also be interfaced with various sensors located to sense environmental conditions inside of and/or external to refrigerator 10, e.g., one or more temperature sensors, humidity sensors, dispense level sensors, etc. Such sensors may be internal or external to refrigerator 10, and may be coupled wirelessly to controller 40 in some implementations. Some sensors may also be cloud-connected in some implementations. Among the various types of sensors that may be incorporated into refrigerator 10 may be one or more door sensors 56 configured to sense the open/closed state of a door, and in some cases, a rotational position of a door, and one or more ambient light sensors 58 configured to sense an ambient light level in the ambient environment of the refrigerator. In some implementations, an ambient light sensor may be a camera or other image sensor, or alternatively a photocell, spectrometer or other sensor capable of measuring color and/or light intensity.

In some implementations, controller 40 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some implementations a home automation network, and various communication protocols may be supported, including various types of home automation communication protocols. In other implementations, other wireless protocols, e.g., Wi-Fi or Bluetooth, may be used.

In some implementations, refrigerator 10 may be interfaced with one or more user devices 64 over network 62, e.g., computers, tablets, smart phones, wearable devices, etc., and through which refrigerator 10 may be controlled and/or refrigerator 10 may provide user feedback. Refrigerator 10 may also be interfaced in some implementations with one or more remote services 66, e.g., various cloud or remote computing services.

In some implementations, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some implementations, the operational sequences performed by controller 40 to implement the implementations disclosed herein may be implemented using program code including one or more instructions that are resident at various times in various memory and storage devices, and that, when read and executed by one or more hardware-based processors, perform the operations embodying desired functionality. Moreover, in some implementations, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Refrigerator with Sequential Interior Lighting

Implementations consistent with the invention may utilize sequential interior lighting to "stage" the activation of lights that illuminate the interior of a refrigerator compartment. Doing so may provide a more pleasant user experience, particularly in dark ambient environments such as dark kitchens and basements, where otherwise full light activation upon door opening could potentially overwhelm the user's eyes and require some period of time to enable the user's eyes to acclimate to the light in the compartment before the user is able to locate desired items in the compartment. Beyond the general unpleasantness of the sudden onset of bright lights in a dark environment, the time associated with acclimating to changes in lighting can increase the amount of time that a refrigerator door is open, causing an increase in energy consumption due to an increase in the internal temperature of the compartment, as well as an increase in the amount of time that the interior lights of the compartment are active. Furthermore, staging the activation of lights in the manner disclosed herein can also reduce energy consumption during the initial moments when a door is open, as only a subset of lights are initially active.

In implementations consistent with the invention, sequential interior lighting may be considered to include various manners of activating a plurality of a lights in a compartment of a refrigerator upon opening of a door, where at least one of the plurality of lights is activated prior to activation of another of the plurality of lights. As will become more apparent below, some implementations may simply include two interior compartment lights, and sequential activation of the two interior compartment lights may include, upon detecting the opening of a door, activating a first of the two lights, waiting a predetermined duration, and then activating a second light after the predetermined duration. In other implementations, however, an interior lighting scheme may be defined including two or more stages during which different subsets of a plurality of lights are activated. In some implementations, for example, more than two lights may be provided such that sequential interior lighting may include more than two sequential stages, and in some implementations, each stage may activate multiple lights. In still other implementations, the different stages may implement various types of animations that may be considered interesting or pleasing to a user, e.g., a "chasing lights" animation, a linear activation animation, a wraparound animation, a back to front or front to back animation, a blinking animation, etc.

Moreover, as will become more apparent below, various interior lighting schemes may be based at least in part on ambient light level as detected by one or more ambient light sensors, e.g., such that one interior lighting scheme is used in low light conditions, and other interior lighting scheme is used in higher (e.g., normal) light conditions. In addition, in some implementations, various interior lighting schemes may be based at least in part on door position as detected by a door sensor that is capable of detecting multiple open positions of the door (e.g., multiple intermediate positions between a fully closed position and a fully open position). Interior lighting schemes in some implementations may also control other lighting aspects, e.g., light color, light temperature, light intensity, etc. Lights may also be activated or deactivated instantaneously in some implementations, while in other implementations, transitions between different lighting levels may be more incremental, e.g., by fading between different lighting levels.

Moreover, it will be appreciated that interior lights utilized in connection with sequential interior lighting may be implemented in a number of different manners, and may be disposed at different locations in a refrigerator compartment. FIG. 3, for example, illustrates a refrigerator 100 including a food storage compartment 102 (e.g., a fresh food compartment, and with the doors thereto omitted for clarity), which includes a top wall 104, bottom wall 106, side walls 108, 110, and a back wall 112. In addition, compartment 102 may include various components disposed therein, e.g., one or more shelves 114, one or more drawers 116, a control panel 118, and a water filter 120.

FIG. 3 also illustrates a number of different types and locations of lights that may be used in connection with sequential interior lighting as described herein. For example, a plurality of light strips 122, 124, 126, and 128 are illustrated, each including a plurality of lights (e.g., LED lights) arranged in a one-dimensional array. Light strips 122, 124 are linear arrays respectively disposed on top and bottom walls 104, 106, while light strips 126, 128 are curved arrays having multiple subsets of lights, with one subset disposed on back wall 112 and another subset disposed on a side wall 108, 110. Through sequential activation of lights in such light strips, different animations may be supported. For example, one example animation is a back to front animation, where lights in one or both of light strips 122, 124 and proximate back wall 112 are activated prior to those proximate the opening of the compartment. A front to back animation may be similar, but in the reverse direction. Another example animation is a wraparound animation, where lights in one or both of light strips 126, 128 and proximate a midline of back wall 112 are activated prior to lights proximate the back corners formed by back wall 112 and side walls 108, 110, which are activated prior to lights proximate the opening of the compartment, such that the lights are activated generally from the midline, along the back wall, and to and along a side wall. In some implementations, lights may be activated one by one on each light strip 122, 124, 126, 128 to implement such animations, while in other implementations, multiple lights may be activated concurrently with one another. In addition, some lights may be disposed on various components in compartment 102, e.g., lights 130 on shelves 114, lights 132 on or in drawers 116, lights 134 on control panel 118, and lights 136 on filter 120.

It will be appreciated that light strips 122-128 and lights 130-136 may be implemented using various types of light technologies, e.g., LED, incandescent, fluorescent, halogen, etc., and may be replaceable (e.g., bulbs) or non-replaceable in different implementations. Moreover, while multiple combinations of light strips 122-128 and lights 130-136 are illustrated in FIG. 3, in other implementations, fewer lights may be used (e.g., as few as two lights), and in other implementations, additional lights and/or light mounting locations may be used, so the invention is not limited to the specific collection of light strips and lights illustrated in in FIG. 3.

Figure 4:
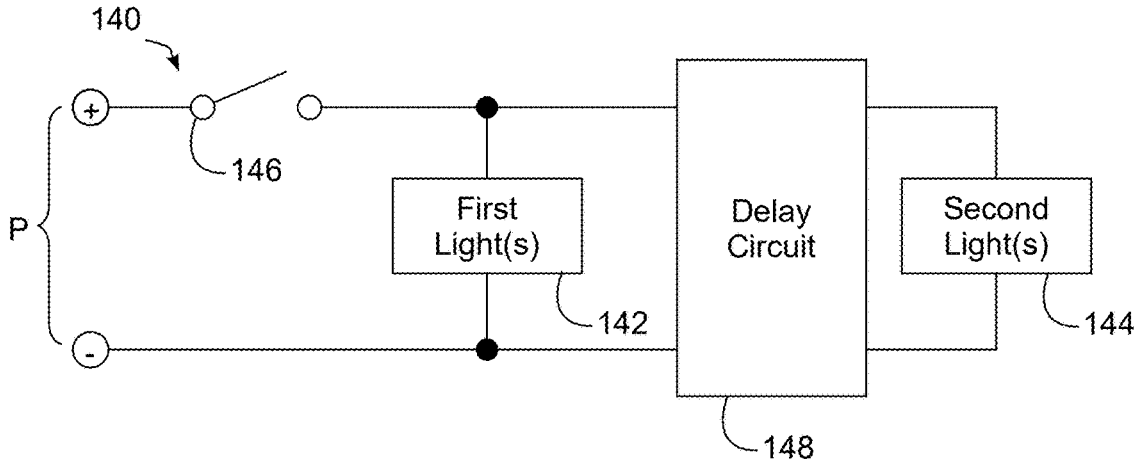
FIG. 4 is a circuit diagram of an example lighting circuit capable of being used in the refrigerator of FIGS. 1-2.

The manner in which lights may be controlled to implement sequential interior lighting may vary in different implementations. For example, as illustrated by circuit 140 in FIG. 4, sequential interior lighting may be implemented even without the use of a controller. In circuit 140, one or more first lights 142 are coupled in parallel with one or more second lights 144, and coupled in series to a DC power supply P through a door switch 146, but with a delay circuit 148 coupled between power supply P and second light(s) 144. Upon initial opening of the door as detected by switch 146, power is supplied to activate first light(s) 142, while delay circuit 148 waits a predetermined duration before activating second light(s) 144. Delay circuit 148 may be implemented in a number of different manners, e.g., using various combinations of passive (e.g., resistors, capacitors, inductors, etc.) and/or active (e.g., diodes, transistors, etc.) components, the implementation of which would be understood by one of ordinary skill in the art having the benefit of the instant disclosure.

In other implementations, however, a controller or other programmable logic circuit may be used to implement various sequential interior lighting schemes. FIGS. 5-8, for example, illustrate various types of lighting schemes capable of being used with a light strip such as any of light strips 122-128 of FIG. 3.

Figure 5:
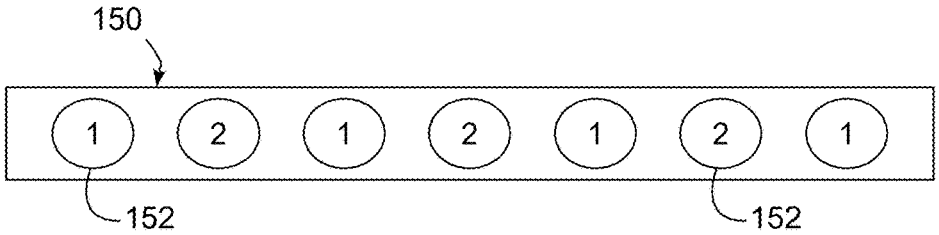
FIGS. 5-8 illustrate various lighting schemes capable of being used with a light strip in the refrigerator of FIGS. 1-2.

FIG. 5, for example, illustrates a light strip 150 including a plurality of lights 152, where a first subset of lights 152

(designated with a "1") are activated concurrently with one another, while a second subset of lights 152 (designated with a "2") and activated concurrently with one another but sequentially with respect to the lights in the first subset, i.e., after a delay.

Figure 6:
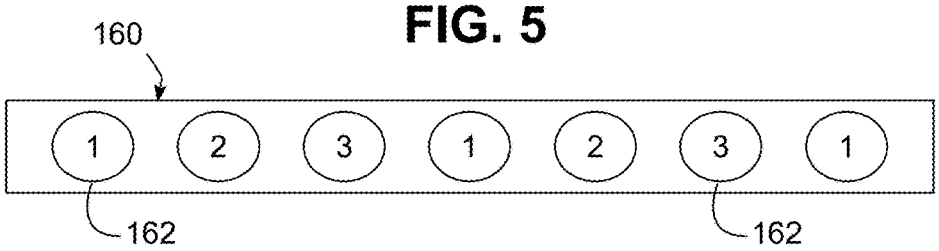

FIG. 6 illustrates a light strip 160 including three subsets of lights 162, respectively designated using "1", "2", and "3", and where the lights within each subset are activated concurrently, but with each subset activated sequentially in the order "1-2-3," and with a delay between each subset.

Figure 7:
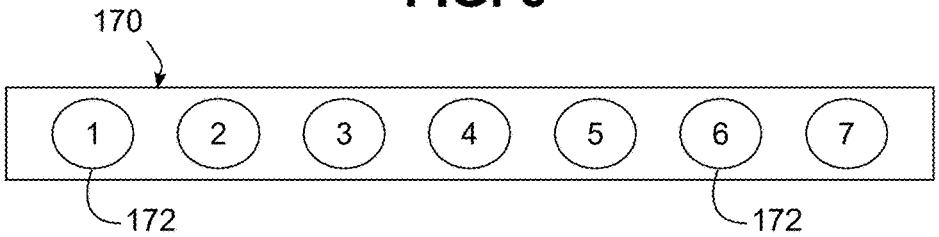
Figure 8:
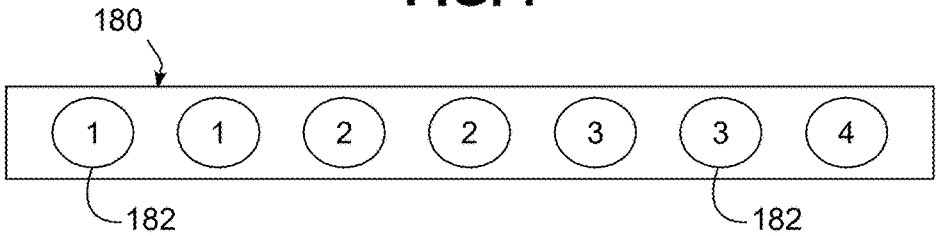

FIG. 7 illustrates a light strip 170 where each light 172 is activated individually and in sequence (e.g., in the order "1-2-3-4-5-6-7"). Light strip 180 of FIG. 8 is similar to light strip 170 of FIG. 7, but rather than activating individual lights 172 in sequence, multiple subsets of lights 182 are activated in sequence (e.g., "1-2-3-4"). Of note, rather than the different subsets of lights being interleaved with one another (e.g., as is the case for light strips 150 and 160), the subsets of lights in light strips 170 and 180 are arranged sequentially along the one-dimensional arrays defined by the light strips. Doing so may be useful for simulating motion in an animation, e.g., to implement a back to front, front to back, or wraparound animation as discussed above in connection with FIG. 3.

Figure 9:
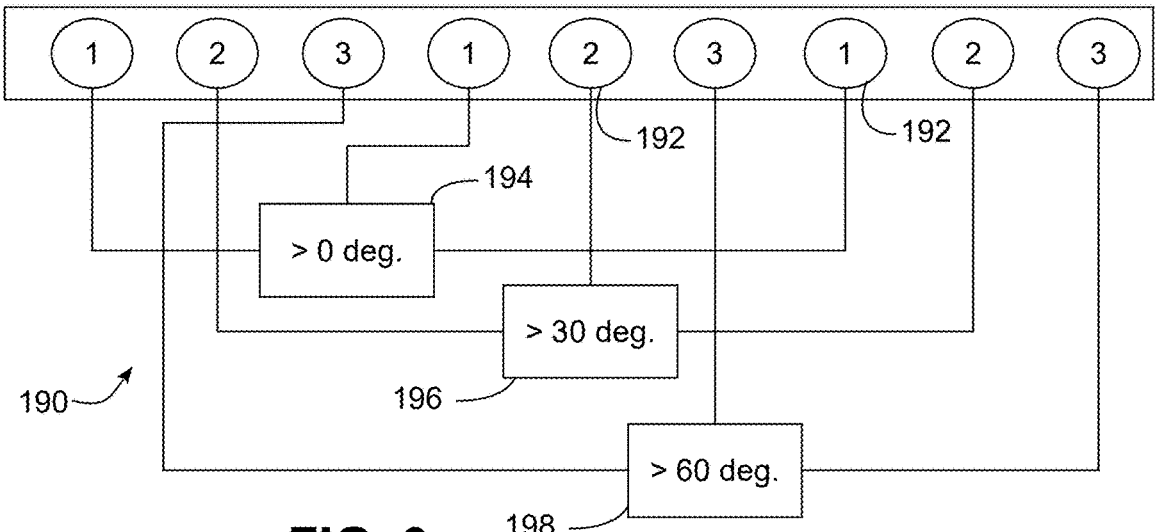
FIG. 9 illustrates another lighting scheme capable of being used with a light strip in the refrigerator of FIGS. 1-2, and incorporating support for variable door positions.

Next, turning to FIG. 9, as discussed above, a door position sensor capable of sensing multiple open door positions may be used in some implementations to illuminate a light strip 190 including a plurality of lights 192. For example, an encoder or potentiometer may be used as a door sensor in some implementations, while in other implementations, a door sensor may utilize a plurality of switches that are activated at different positions of a door (e.g., rotational positions for a hinged door or linear positions for a sliding door)

With such a door sensor, two or more lighting schemes may be defined for different ranges of door positions. In the implementation illustrated in FIG. 9, for example, a door position sensor may include three switches 194, 196, 198 configured to activate respectively at 0 degrees (where 0 degrees corresponds to the door closed position), 30 degrees, and 60 degrees 198. Thus, as a user initially opens the door, a first subset of lights 192 (designated using "1") is activated, and as the door is opened to 30 degrees, a second subset of lights 192 (designated using "2") is activated. As the door is further opened to 60 degrees and beyond, a third subset of lights 192 (designated using "3") is activated. It should also be noted that in this implementation, a predetermined delay may not need to be implemented between activating each subset of lights, as the physical movement of the door may effectively implement the delay between the activation of the different subsets of lights. In other implementations, however, e.g., where the opening of the door is too sudden, it still may be desirable to implement at least a minimum predetermined delay between activating each subset of lights.

Figure 10:
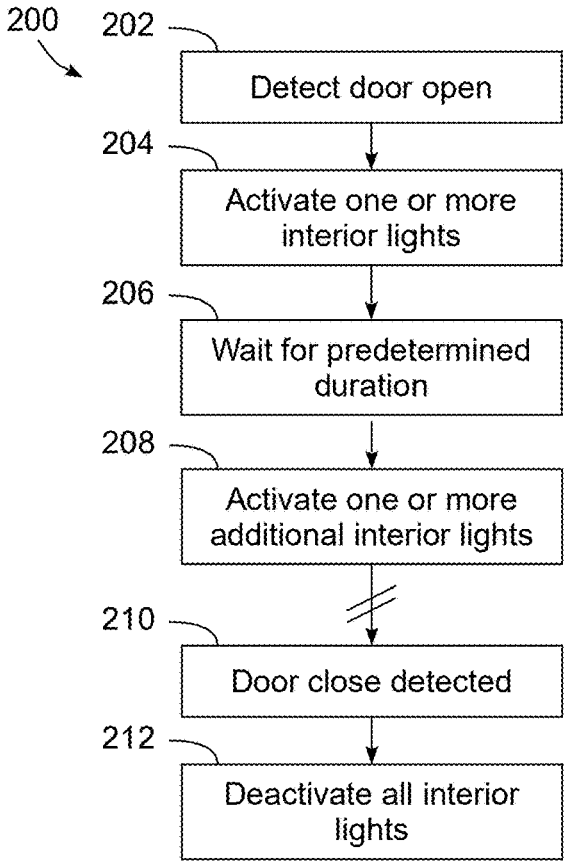
FIG. 10 is a flowchart illustrating an example operational sequence for illuminating a compartment of the refrigerator of FIGS. 1-2.

FIG. 10 next illustrates an operational sequence 200 capable of being executed, for example, by controller 40 of FIG. 2, to illuminate a food storage compartment of a refrigerator consistent with some implementations. In block 202, door opening is detected, e.g., using a door switch or door sensor, and in block 204, one or more interior lights is activated. Next, in block 206, a delay, e.g., of a predetermined duration, is inserted, and in block 208, one or more additional interior lights is activated. Then, at some later point in time, closing of the door is detected in block 210, and all interior lights are deactivated in block 212.

Figure 11:
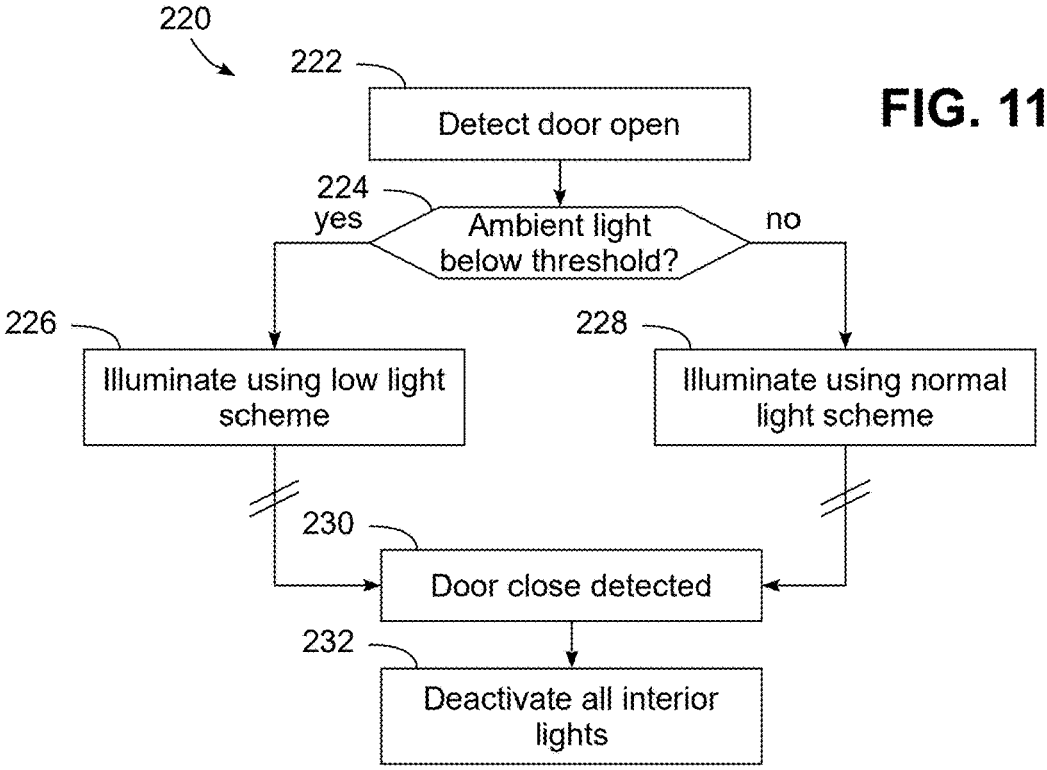
FIG. 11 is a flowchart illustrating another example operational sequence for illuminating a compartment of the refrigerator of FIGS. 1-2, and further based on ambient light level.

Next, as illustrated in FIG. 11, it may be desirable in some implementations to use an ambient light sensor to detect the ambient light in the environment surrounding the refrigerator when a door is opened, such that the lighting scheme used to illuminate the food storage compartment is varied based on the level of ambient light. FIG. 11 in particular illustrates an operational sequence 220 capable of being executed, for example, by controller 40 of FIG. 2, to illuminate a food storage compartment of a refrigerator consistent with some implementations, and utilizing an ambient light sensor. In block 222, door opening is detected, e.g., using a door switch or door sensor, and in block 224, a determination is made as to whether the ambient light meets a low light criterion, e.g., whether the ambient light level is below a predetermined threshold. It will be appreciated that other criteria may be used in other implementations, and that multiple criteria, e.g., multiple ambient light levels, may be used in some implementations.

If the low light criterion is met, control passes to block 226 to illuminate the food storage compartment using a low light scheme, whereas if the low light criterion is not met, control passes to block 228 to illuminate the food storage compartment using a normal light scheme. Various lighting schemes may be used for each of the low light and normal light scheme in different implementations (e.g., any of the schemes discussed above in connection with FIGS. 5-9, among others). For example, in one implementation, a low light scheme may sequentially activate two different subsets of lights, while a normal light scheme may concurrently activate both subsets of lights, such that sequential interior lighting is only used when the ambient light level is below a low light threshold. It will be appreciated that the need to acclimate one's eyes upon initial opening of a door is generally more pronounced in low ambient light, so in general it may be desirable to increase the illumination level in a food storage compartment more slowly in low ambient light than in higher ambient light conditions.

Returning to FIG. 11, at some later point in time, closing of the door is detected in block 230, and all interior lights are deactivated in block 232.

Figure 12:
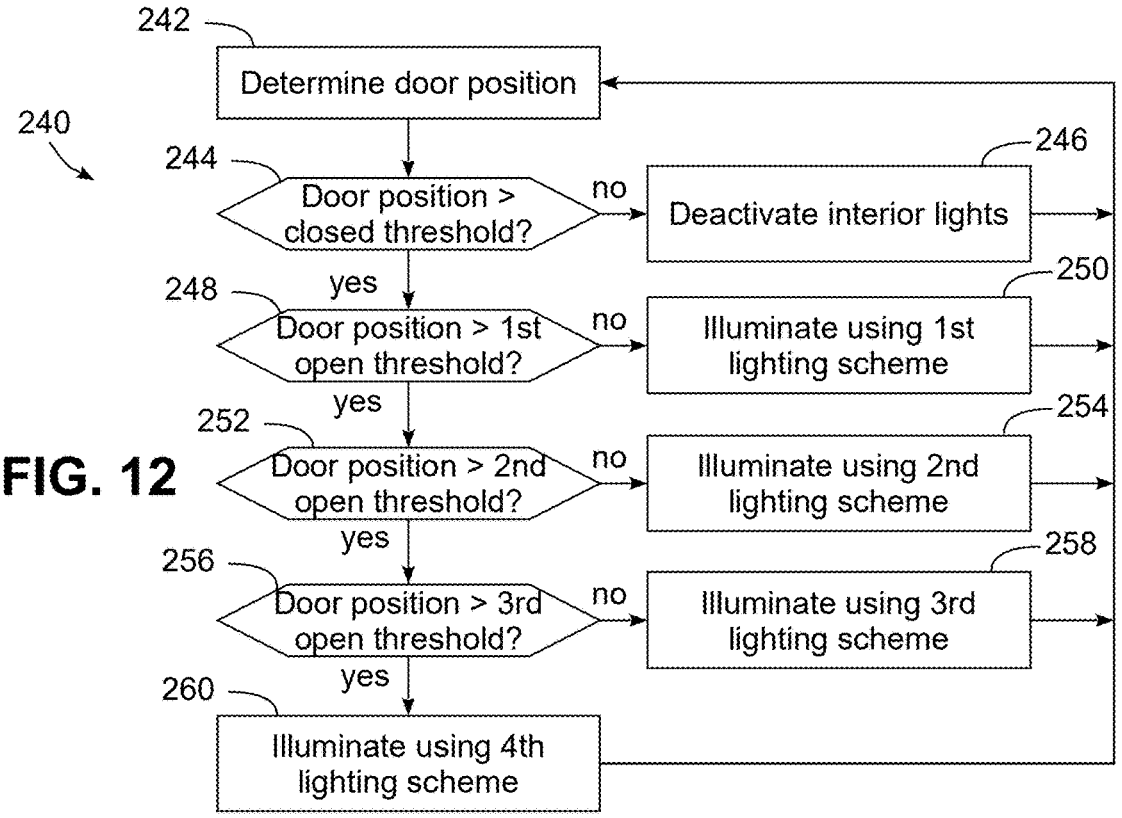
FIG. 12 is a flowchart illustrating another example operational sequence for illuminating a compartment of the refrigerator of FIGS. 1-2, and further based on door position.

Next, as illustrated in FIG. 12, and as noted above in connection with FIG. 9, it may be desirable in some implementations to use door sensor capable of detecting multiple open door positions, such that the lighting scheme used to illuminate the food storage compartment is varied based on the degree to which the door is open. FIG. 12 in particular illustrates an operational sequence 240 capable of being executed, for example, by controller 40 of FIG. 2, to illuminate a food storage compartment of a refrigerator consistent with some implementations, and utilizing a multi-position door sensor. In block 242, a position of the door is determined, and in block 244 a determination is made as to whether the door position meets a first criterion, e.g., being greater than a closed threshold corresponding to a closed door. If not, the door is closed, and control passes to block 246 to deactivate all interior lights. Control then returns to block 242.

If so, however, block 244 passes control to block 248 to determine if the door position meets a first open door criterion, e.g., being greater than a first open threshold. If not, control passes to block 250 to illuminate the food storage compartment using a first lighting scheme. Control then returns to block 242. If so, however, block 248 passes control to block 252 to determine if the door position meets a second open door criterion, e.g., being greater than a second open threshold. If not, control passes to block 254 to illuminate the food storage compartment using a second lighting scheme. Control then returns to block 242.

If so, however, block 252 passes control to block 256 to determine if the door position meets a third open door criterion, e.g., being greater than a third open threshold. If not, control passes to block 258 to illuminate the food storage compartment using a third lighting scheme. If so, however, block 256 passes control to block 260 to illuminate the food storage compartment using a fourth lighting scheme. After execution of each of blocks 258, 260, control returns to block 242.

The first, second, third, and fourth lighting schemes may be differ from one another in various manners, e.g., using different combinations of active lights, different colors, different intensities, different animations, different color temperatures, etc., although in general it may be desirable in many implementations to provide an overall illumination level that increases the further the door is opened (e.g., in some implementations by increasing the number of activated lights the further the door is moved away from the closed position). It will also be appreciated that greater or lesser numbers of lighting schemes and door positions may be used in other implementations, so the invention is not limited to the use of four different lighting schemes as illustrated in FIG. 12.

Figure 13:
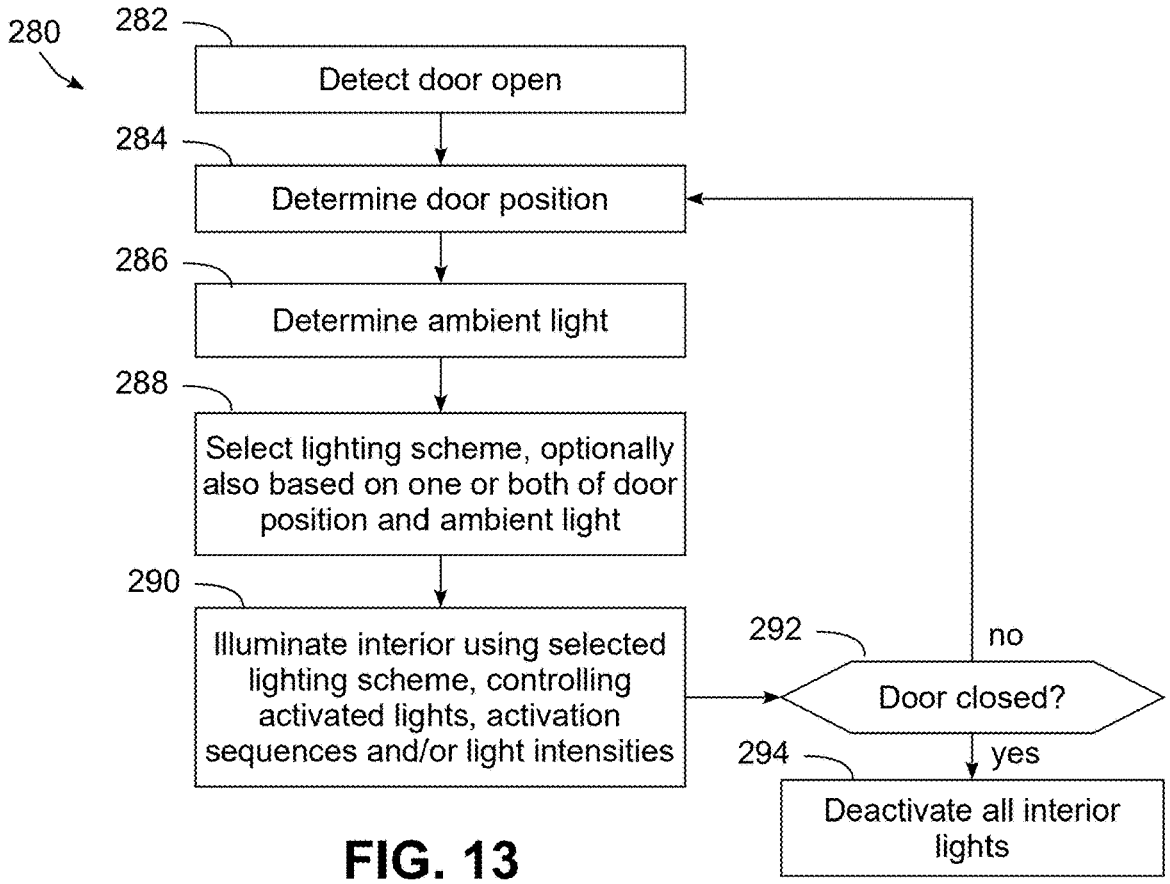
FIG. 13 is a flowchart illustrating another example operational sequence for illuminating a compartment of the refrigerator of FIGS. 1-2, and further based on one or both of ambient light level and door position.

Now turning to FIG. 13, it will be appreciated that sequential interior lighting may utilize one or both of ambient light level and door position (or neither) in various implementations. FIG. 13 in particular illustrates an operational sequence 280 capable of being executed, for example, by controller 40 of FIG. 2, to illuminate a food storage compartment of a refrigerator consistent with some implementations, and utilizing both an ambient light sensor and a multi-position door sensor. In block 282, opening of a door is detected, and in block 284, a position of the door is determined using the multi-position door sensor. Next, in block 286 the ambient light level is determined using the ambient light sensor, and in block 288, a lighting scheme is selected based on none, one or both of the door position and ambient light level. The selected lighting scheme is then used to illuminate the food storage compartment in block 290. It will be appreciated that various lighting schemes as described herein may be used, and a selected lighting scheme may control one or more of the number of lights activated, which lights are activated, the sequence in which the lights are activated (e.g., when presenting an animation), the intensities of the activated lights, the colors of the lights, the color temperatures of the lights, etc.

Next, control passes to block 292 to determine if the door has been closed, and if not, control returns to block 284, where none, one or both of the door position and ambient light level are again used to potentially adjust the lighting scheme used to illuminate the food storage compartment. Thus, for example, if the door position is changed, or if the ambient light level changes (e.g., a kitchen light is turned on or off), a different lighting scheme may be selected and used to illuminate the food storage compartment. However, once closing of the door is detected in block 292, control passes to block 294 to deactivate all interior lights, and sequence 280 is complete.

It will be appreciated that the aforementioned techniques may also be utilized in connection with lighting other compartments in a refrigerator, including, for example, the interior of a drawer or sub-compartment in a fresh food or freezer compartment. As an example, sequential interior lighting may be used in connection with lighting a drawer in response to opening the drawer, including the use of different lighting schemes based on the position of the drawer. In such implementations, the drawer itself functions as a door to its interior, and it will be appreciated that any of the techniques described above in connection with FIGS. 10-13 may be utilized to light the drawer interior.

It will also be appreciated that, while certain features may be discussed herein in connection with certain implementations and/or in connection with certain figures, unless expressly stated to the contrary, such features generally may be incorporated into any of the implementations discussed and illustrated herein. Moreover, features that are disclosed as being combined in some implementations may generally be implemented separately in other implementations, and features that are disclosed as being implemented separately in some implementations may be combined in other implementations, so the fact that a particular feature is discussed in the context of one implementation but not another should not be construed as an admission that those two implementations are mutually exclusive of one another. Various additional modifications may be made to the illustrated implementations consistent with the invention. Therefore, the invention lies in the claims hereinafter appended.

What is claimed is:

1. A refrigerator, comprising:

a cabinet including a food storage compartment defined therein;

a door coupled to the cabinet to provide external access to the food storage compartment, the door movable between closed and open positions;

a plurality of lights disposed within the food storage compartment; and a controller coupled to the plurality of lights, the controller configured to detect opening of the door, and the controller further configured to, in response to detecting opening of the door, illuminate the food storage compartment by sequentially activating first and second lights of the plurality of lights such that the first light is activated prior to activation of the second light;

wherein the plurality of lights includes a first subset of lights extending generally from a midline of the food storage compartment to and along a first side wall of the food storage compartment and a second subset of lights extending generally from the midline to and along a second side wall of the food storage compartment, and the controller is configured to illuminate the food storage compartment by sequentially activating lights from each of the first and second subset of lights starting proximate the midline to generate a wrap-around animation.

2. The refrigerator of claim 1, wherein the controller is further configured to illuminate the food storage compartment by sequentially activating a third light of the plurality of lights such that the third light is activated after activation of each of the first and second lights.

3. The refrigerator of claim 1, wherein the controller is configured to sequentially activate the first and second lights of the plurality of lights by activating the first light, waiting a predetermined duration after activating the first light, and activating the second light after waiting the predetermined duration.

4. The refrigerator of claim 1, wherein the plurality of lights includes a one-dimensional array of three or more lights, and the controller is configured to illuminate the food storage compartment by sequentially activating the three or more lights along a length of the one-dimensional array.

5. The refrigerator of claim 4, wherein the one-dimensional array is linear.

6. The refrigerator of claim 4, wherein at least a portion of the one-dimensional array is curved.

7. The refrigerator of claim 4, wherein at least a portion of the one-dimensional array is arranged in a generally back to front direction within the food storage compartment, and the controller is configured to illuminate the food storage compartment by sequentially activating the at least a portion of the one-dimensional array in a generally back to front or front to back direction to generate a back to front or front to back animation.

8. The refrigerator of claim 1, wherein the first light is among a first subset of the plurality of lights and the second light is among a second subset of the plurality of lights, each of the first and second subsets of the plurality of lights includes more than one light, and the controller is configured to concurrently activate the first subset of lights when activating the first light and concurrently activate the second subset of lights when activating the second light.

9. The refrigerator of claim 8, wherein the plurality of lights further includes a third subset including more than one light, and the controller is configured to concurrently activate the first third subset of lights sequentially after activating the second subset of lights.

10. The refrigerator of claim 1, further comprising a door position sensor, and the controller is configured to detect opening of the door using the door position sensor.

11. The refrigerator of claim 1, wherein at least one of the plurality of lights has a variable intensity, and the controller is further configured to vary the intensity of the at least one of the plurality of lights when illuminating the food storage compartment.

12. The refrigerator of claim 1, further comprising an ambient light sensor, wherein the controller is configured to sequentially activate first and second lights of the plurality of lights further based on an ambient light level sensed by the ambient light sensor.

13. The refrigerator of claim 12, wherein the controller is configured to sequentially activate the first and second lights in response to the ambient light level meeting a low light criterion, and to activate the first and second lights concurrently in response to the ambient light level not meeting the low light criterion.

14. The refrigerator of claim 1, wherein at least a subset of the plurality of lights is disposed on a rear wall, a side wall, a top wall or a bottom wall of the food storage compartment.

15. The refrigerator of claim 1, wherein at least a subset of the plurality of lights is disposed on a component disposed in the food storage compartment, wherein the component is a shelf, a drawer, a filter, or a control panel.

16. The refrigerator of claim 1, wherein at least a subset of the plurality of lights is disposed on an interior surface of the door.

17. The refrigerator of claim 1, further comprising a drawer disposed in the food storage compartment, wherein at least a subset of the plurality of lights is positioned to illuminate an interior of the drawer, and wherein the controller is further configured to detect opening of the drawer, and in response to detecting opening of the drawer, illuminate the interior of the drawer using the subset of the plurality of lights.

18. A refrigerator, comprising:

a cabinet including a food storage compartment defined therein;

a door coupled to the cabinet to provide external access to the food storage compartment, the door movable between closed and open positions;

a door position sensor;

a plurality of lights disposed within the food storage compartment; and a controller coupled to the plurality of lights, the controller configured to detect opening of the door using the door position sensor, and the controller further configured to, in response to detecting opening of the door, illuminate the food storage compartment by sequentially activating first and second lights of the plurality of lights such that the first light is activated prior to activation of the second light;

wherein the door position sensor is configured to detect a plurality of open positions of the door having different rotational differences from the closed position, and the controller is configured to illuminate the food storage compartment by increasing a number of activated lights of the plurality of lights as a current position of the door moves away from the closed position.

19. The refrigerator of claim 18, wherein the plurality of lights includes a first subset of lights extending generally from a midline of the food storage compartment to and along a first side wall of the food storage compartment and a second subset of lights extending generally from the midline to and along a second side wall of the food storage compartment, and the controller is configured to illuminate the food storage compartment by sequentially activating lights from each of the first and second subset of lights starting proximate the midline to generate a wraparound animation.

20. A method comprising, with a controller of a refrigerator of a type including a cabinet having a food storage compartment defined therein and a door coupled to the cabinet and movable between closed and open positions to provide external access to the food storage compartment:

detecting opening of the door; and in response to detecting opening of the door, illuminating the food storage compartment by sequentially activating first and second lights of a plurality of lights disposed in the food storage compartment such that the first light is activated prior to activation of the second light;

wherein the plurality of lights includes a first subset of lights extending generally from a midline of the food storage compartment to and along a first side wall of the food storage compartment and a second subset of lights extending generally from the midline to and along a second side wall of the food storage compartment, and wherein the food storage compartment includes sequentially activating lights from each of the first and second subset of lights starting proximate the midline to generate a wraparound animation.

* * * * *